United States Patent [19]

Aspinwall

[11] 3,953,147

[45] Apr. 27, 1976

[54] FLUID DYNAMIC MACHINE

[75] Inventor: Robert H. Aspinwall, Zionsville, Ind.

[73] Assignee: General Motors Corporation, Detroit, Mich.

[22] Filed: June 27, 1974

[21] Appl. No.: 483,877

[52] U.S. Cl. ..... 415/143; 415/211

[51] Int. Cl.[2] ..... F04D 17/14

[58] Field of Search ..... 415/74, 211, 143, 181; 416/233

[56] References Cited

UNITED STATES PATENTS

| | | | |
|---|---|---|---|
| 2,114,285 | 4/1938 | Berger | 415/211 |
| 2,827,261 | 3/1958 | Parker et al. | 415/143 |
| 3,628,226 | 12/1971 | Nelson | 416/233 |
| 3,781,126 | 12/1973 | Benisek | 415/178 |
| 3,829,235 | 8/1974 | Woolenweber, Jr. | 415/178 |

FOREIGN PATENTS OR APPLICATIONS

| | | | |
|---|---|---|---|
| 186,560 | 6/1907 | Germany | 415/143 |
| 610,726 | 3/1935 | Germany | 415/143 |
| 699,743 | 12/1940 | Germany | 415/211 |
| 714,238 | 11/1941 | Germany | 415/143 |
| 1,528,793 | 3/1970 | Germany | 415/143 |

*Primary Examiner*—Henry F. Raduazo
*Attorney, Agent, or Firm*—Paul Fitzpatrick

[57] ABSTRACT

A fluid dynamic machine has a single rotor providing the rotor portion of a centrifugal compressor and also the rotor portion of an axial-to-radial flow fan. The portion of the rotor blades adjacent the hub define a compressor blading and the axially forward part of each blade is extended outwardly to provide a fan blade. These are supplied from a common inlet eye, and the flow is split at the downstream side of the fan between the fan and compressor passages by a generally radial plate curving forwardly at its inner margin and providing the forward fixed shroud for the compressor blades. The fan diffuser is split in a generally diametrical direction.

1 Claim, 2 Drawing Figures

FLUID DYNAMIC MACHINE

My invention relates to fluid dynamic machines and particularly to a single stage fan-compressor capable of supplying two outlets with a compressed gas such as air. More particularly, the invention is directed to a single-stage axial-to-radial fan combined with a single-stage centrifugal compressor, the characteristics being such that the compressor may serve as the air compressor of a gas turbine engine including a turbine which drives the rotor and the fan portion of the rotor may deliver service air at a substantial pressure; that is, with a pressure rise of the order of two times.

A device of this character may have various applications, but two are contemplated by me. One application is to a gas turbine engine acting as an air pump to supply air for some particular purpose as, for example, for blowing particulate cargo or for energizing an air motor. Another field of application of such a combined fan and compressor is to a simple relatively inexpensive fan jet engine for propulsion of light aircraft of various types.

Combinations of fan and compressor with a common rotor have been proposed: I call attention to the two of which I am aware. One of these is British Pat. No. 761,937 to Garrett Corporation, published Nov. 21, 1956, and the other is Benisek U.S. Pat. No. 3,781,126, issued Dec. 25, 1973. However, it will be seen from the subsequent description of the preferred embodiment of my invention that there are substantial and significant differences between my fluid dynamic machine and those disclosed in the two patents mentioned.

The principal object of my invention are to provide a simple, economical, and effective combined centrifugal compressor of pressure ratio of the order of 4 to 7 and fan of pressure ratio of the order of 2. A further object is to provide a simple readily fabricated structure for such a fluid dynamic machine. A still further object is to advance the design of gas pumping gas turbine engines and fan jet engines of small size.

The nature of my invention and its advantages will be apparent to those skilled in the art from the succeeding detailed description of the preferred embodiment of the invention, the accompanying drawings thereof, and the appended claims.

Referring to the drawings.

Figure 1:
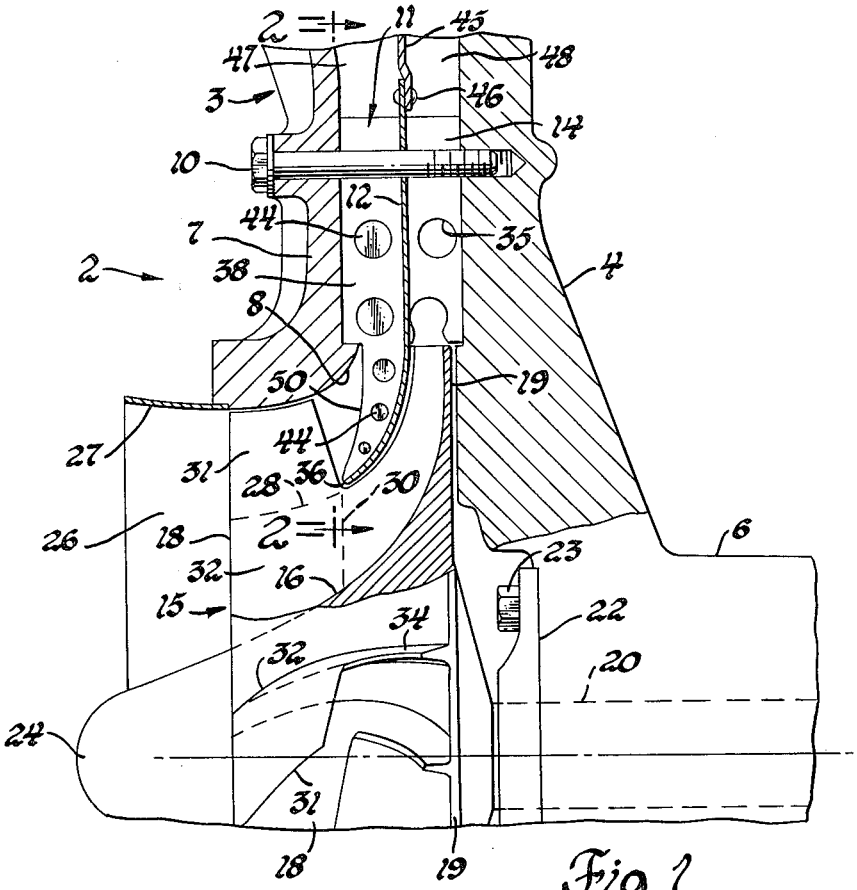
FIG. 1 is a partial view of a fan-compressor with parts cut away and shown partly in a radial plane extending from the axis of rotation.

As shown in FIG. 1, the combined fan and compressor 2 includes a stator or housing 3. The housing includes a back plate 4 which may be part of the frame of the gas turbine engine and which may be integral with a shaft housing 6. The stator also includes a front plate 7 having a rearwardly diverging inner surface 8 of circular cross section which defines the outer boundary of flow through the rotor of the machine. The front plate is fixed to the back plate by a ring of cap screws 10 threaded into the back plate. The fan diffuser structure 11, a divider plate 12, and a compressor diffuser structure 14 are clamped between the front and back plates by the cap screws 10.

The rotor 15 is essentially a single piece bladed structure including a flaring hub 16 and blades 18 extending generally radially from the hub. The hub 16 extends radially outwardly and at its outer margin is a radial disk 19 from which the blades 18 project generally forwardly. Hub 16 is suitably supported for rotation by a shaft 20 mounted in the housing 6 by suitable bearings (not illustrated). The shaft 20 may be driven by the turbine of a gas turbine engine supplied by this compressor. The shaft bearings and seals (not illustrated) may be held in place by a retainer ring 22 fixed to the forward face of the shaft housing 6 by cap screws 23.

As illustrated, the rotor is overhung; that is, it has no forward bearing. A nose cone or inlet fairing 24 defining the inner boundary of the air inlet or inlet eye 26 of the compressor is fixed to or integral with the hub 16. The air inlet eye is bounded at its outer margin by a sheet metal ring 27 which converges slightly and is fixed at the forward edge of the inner surface 8 of front plate 7.

Proceeding now to the blading of the rotor 15, it is helpful in analysis to consider each rotor blade 18 as divided into three regions which join along the surfaces indicated by the broken lines 28 and 30 in FIG. 1. Line 28 indicates generally the division between the fan portion 31 of each blade and the compressor inducer portion 32. Line 30 indicates the demarcation between the inducer portion 32 and the downstream impeller portion 34 of the compressor blading.

The portions 32 and 34 of the blades may constitute a conventional centrifugal compressor rotor. Many of these are produced in large quantities and their design is well understood. Reference may be made to Atkinson U.S. Pat. No. 2,819,012 issued Jan. 7, 1958, for description of principles of design of one suitable centrifugal compressor rotor. The inducer portion 32 curves forwardly in the direction of rotation, as will be more clearly apparent from the elevation view in the lower part of FIG. 1. The fan portion of the blade is essentially a continuation of the inducer portion extending radially outwardly. A pressure ratio of the order of 2 to 1 is readily obtainable with present technology from a single axial-flow blade stage such as is provided by the blade portion 31 and the succeeding diffuser to be described.

The centrifugal compressor defined by blade portions 32 and 34 discharges the air with a radial component and a large tangential component, and the air so discharged is diffused in a diffuser in which the velocity head is largely converted to static pressure head. Any suitable prior art diffuser may be used. The diffuser 14 illustrated in FIG. 1 may be specifically as described in Bandukwalla U.S. Pat. No. 3,778,186 issued Dec. 11, 1973. The diffuser is an annular body defining diverging passages 35 extending generally spirally from the rotor. Such structure need not be described in detail, since the details are immaterial to my present invention.

Figure 2:
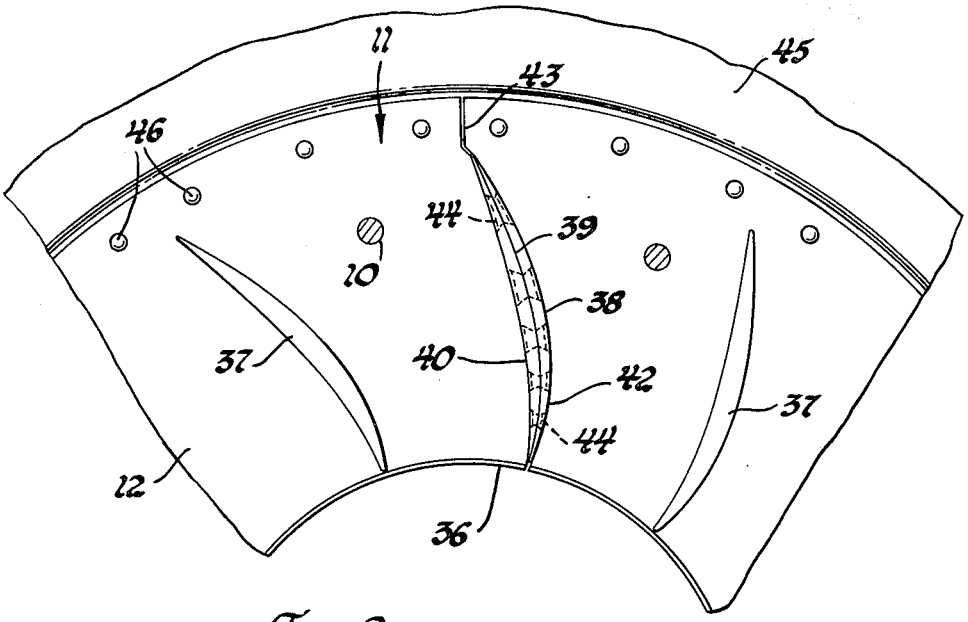
FIG. 2 is a partial transverse sectional view of the compressor stator taken in the plane indicated by the line 2—2 in FIG. 1.

The fan blade portions 31 discharge into fan diffuser 11 the structure of which may be described in somewhat greater detail. The divider plate 12 which abuts the forward surface of diffuser 14 and the rear surface of diffuser 11 provides the forward shroud for the centrifugal compressor rotor and the rear boundary of the discharge passage from the fan. The inner margin 36 of this plate thus divides the flow between fan diffuser and compressor impeller. Plate 12 may be considered to be a part of the diffuser, and structurally it is integrated with the fan diffuser as one unit of the compressor assembly. Referring also to FIG. 2, the plate 12 bears an annular array of radially extending diffuser vanes 37 and 38 which are brazed or welded to the plate. The vanes 38 are similar in function to the vanes 37 but the two vanes 38, which are at opposite sides of the centerline of the apparatus, are formed in two portions abutting approximately on the mean camber surface of the vane indicated at 39. The divider plate 12 is divided along the same surface 39, and its marginal portion is split as indicated at 43. Thus each semicircular section of the divider plate 12 bears a suitable number of vanes 37 and bears one half of a vane 38 at each margin. Thus splitting the divider plate 12 and diffuser 11 permits the diffuser to be assembled around the rotor between the portions 31 and 34 of the blades.

As illustrated, the two portions 40 and 42 of each blade 38 are fixed together by rivets 44. The rivets are countersunk and have their end surfaces flush with the faces of the vanes 38. It is also possible to fix the vanes together by other processes than riveting such as spotwelding, for example. This mode of attachment of the two blade halves together gives a strong structure more resistant to buffeting from the airflow and to leakage than would be the case if the two halves of the plate 12 are retained only by the bolts 10 passing through the plates 12. A sheet metal wall 45, the inner margin of which overlaps the outer margin of the plate 12, separates the discharge passages of the fan and compressor. This may be fixed to plate 12 after it is in place by a ring of rivets 46 or by welding. The discharge passage 47 of the fan and discharge passage 48 of the compressor may continue through any suitable arrangement or ducting to the user of the air or other gas discharged. In the case of a gas turbine engine, the passage 48 will lead through the combustion apparatus of the engine (not illustrated) to a turbine driving shaft 20 (not illustrated). Such an engine might be generally of the type disclosed in Conklin et al U.S. Pat. No. 3,027,717 issued Apr. 3, 1962 or the type disclosed in Collman et al U.S. Pat. No. 3,267,674 issued Aug. 23, 1966, for example.

The fan discharge passage 47 may lead to any user including, without limitation, a system for conveying particulate matter, a gas-driven motor, processing equipment, or the fan duct of a turbofan engine. Obviously, if the system is a turbofan engine, more attention would be paid to minimizing weight of parts than in the case of a land-based power plant such as those illustrated in the patents referred to above.

With the preferred structure, there is no enforced separation between fan and compressor flows ahead of the edge 36 of the divider plate 12. We may assume that line 28 represents the normal demarcation between the two flows. However, changes in condition downstream of the fan or compressor may change relative flows through the fan and compressor. In this case, the flow may accommodate to this, and either fan or compressor may take air from a greater area of the inlet. Since there is no structure ahead of edge 36 to force any particular division of flow area between the fan and compressor, and there is no discontinuity between the curvatures of blade portions 31 and 32 at their junction, such variations in relative inlet area are freely accommodated.

Attention is called to the configuration of the leading edge 50 of the radially inner portion of the diffuser vanes 37 and 38 as shown in FIG. 1. The vaneless space ahead of the diffuser blades is greater towards the outer diameter of the fan so as to allow somewhat more room for vaneless diffusion before the flow intersects the blades. Also, the acute angle of the blade leading edge relative to the direction of flow of the air decreases the relative velocity of the air with respect to the leading edge of the vane thus minimizing shock as the rapidly flowing air encounters the vanes. It is contemplated that the discharge from both the axial-flow and radial-flow portions of the rotor will be supersonic or at least in the transonic range.

It should be apparent from those skilled in the art that the preferred embodiment of the invention provides a combined axial-to-radial fan and radial compressor well suited to many operational requirements.

The detailed description of the preferred embodiment of the invention for the purpose of explaining the principles thereof is not to be considered as limiting or restricting the invention, since many modifications may be made by the exercise of skill in the art.

I claim:

1. A combined high pressure ratio axial-to-radial flow fan and higher pressure ratio centrifugal compressor comprising, in combination, a stator and a rotor rotatably mounted in the stator; the stator defining a single entrance eye to the fan and compressor, the rotor including a hub bearing radially-extending blades, the upstream portions of which define the inducer portion of the centrifugal compressor rotor over the inner part of the blade radius and define axial-flow rotor blades of the fan over the outer part of the blade radius, and the downstream portion of which define the impeller portion having a curved free edge of the centrifugal compressor rotor; the stator including an annular plate having an inlet segment following the curvature of the curved free edge of the impeller portion and defining the forward boundary of the flow passage through the impeller and the rear boundary of a discharge passage from the axial-flow rotor blades, the inner margin of the plate acting as a flow splitter between the fan and compressor; said annular plate having an outlet segment with fore and aft; surfaces extending in a straight line outwardly of the outlet end of the impeller portion; means defining side-by-side located first and second discharge passages on either side of said outlet segment at the outer radial periphery thereof; a diffuser structure including vanes defining diffusing passages from the fan disposed forwardly of the fore surface of said plate, each of said vanes including an inlet portion following the curvature of the inlet segment and a straight radial root segment secured to the fore surface of said plate for directing fan discharge air to said first discharge passage with a pressure ratio of 2 from the inlet of the fan to said first discharge passage, and a centrifugal compressor diffuser defining diffusing passages from the impeller disposed rearwardly of the said plate and communicating the impeller with said second discharge passage and including means for producing a pressure ratio in the range of 4–7 from the inlet of the impeller to said second discharge passage.

* * * * *